US007954424B2

(12) United States Patent
Dunn et al.

(10) Patent No.: US 7,954,424 B2
(45) Date of Patent: Jun. 7, 2011

(54) FULL DEPTH RACK

(75) Inventors: Wesley Owens Dunn, Mount Juliet, TN (US); Timothy David Scott, Greenbrier, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 1079 days.

(21) Appl. No.: 11/464,297

(22) Filed: Aug. 14, 2006

(65) Prior Publication Data

US 2007/0095814 A1 May 3, 2007

Related U.S. Application Data

(60) Provisional application No. 60/731,346, filed on Oct. 28, 2005.

(51) Int. Cl.
*A22C 7/00* (2006.01)
*A23P 1/00* (2006.01)
*A47J 43/18* (2006.01)

(52) U.S. Cl. ..... 99/426; 219/400

(58) Field of Classification Search ..... 99/339, 99/340, 352–355, 348, 444–450, 467–482, 99/426; 126/337 R, 333, 273 R, 215, 332, 126/337 A, 338, 339; 211/153, 41.4, 181.1, 211/126.15, 90.01, 134, 90.03; 312/408; 108/143; 219/391–392, 400–401; D7/409, D7/323, 388, 402
See application file for complete search history.

(56) References Cited

U.S. PATENT DOCUMENTS 676,381 A 6/1901 Ball
1,974,830 A * 9/1934 Moecker ..... 126/339
2,033,861 A 3/1936 Otte
2,671,004 A * 3/1954 Chadwick et al. ..... 312/350
3,012,554 A * 12/1961 Hirsch ..... 126/338
3,246,690 A * 4/1966 Fry ..... 165/64
3,373,754 A * 3/1968 Squire ..... 134/58 D
3,675,638 A * 7/1972 Baltz et al. ..... 126/339
3,789,826 A * 2/1974 Baltz et al. ..... 126/339
3,936,627 A 2/1976 Fitzmayer
3,977,389 A 8/1976 Ondrasik
4,637,373 A * 1/1987 Shirai et al. ..... 126/340
5,287,253 A * 2/1994 Blorstad ..... 362/92
5,775,209 A * 7/1998 Tiemann ..... 99/426
6,067,981 A * 5/2000 Peter et al. ..... 126/337 R
6,148,813 A * 11/2000 Barnes et al. ..... 126/339
6,205,997 B1 3/2001 Bartley
(Continued)

FOREIGN PATENT DOCUMENTS

FR 2681128 3/1993

*Primary Examiner* — M. Alexandra Elve
(74) *Attorney, Agent, or Firm* — Pearne & Gordon LLP

(57) ABSTRACT

A rack for an appliance comprises a support platform including a support frame and a plurality of elongated support wires attached to the support frame to form a support surface extending generally along a plane. An upwardly projecting portion is adapted to engage structure of an appliance to inhibit the rack from being removed therefrom. In one example, at least one leg section is attached to the support platform and extends a distance along a longitudinal axis of the support platform that is less than half of the total length of the support platform. In addition or alternatively, the support frame includes a rear member having a portion that is bent inwardly in a direction towards the front member so as to be spaced a distance from a rear wall of an appliance. In addition or alternatively, an arrangement for supporting items in an appliance includes the rack.

17 Claims, 8 Drawing Sheets

U.S. PATENT DOCUMENTS 6,349,717 B1 * 2/2002 Thompson et al. ..... 126/337 R
6,926,001 B2 * 8/2005 Bartley ..... 126/337 R
D509,406 S * 9/2005 Freese et al. ..... D7/409
D509,706 S * 9/2005 Shin ..... D7/409
6,938,617 B2 * 9/2005 Le et al. ..... 126/339
6,945,245 B1 * 9/2005 Wilson ..... 126/337 R
D510,839 S * 10/2005 Shin ..... D7/409
D554,160 S * 10/2007 Morrison et al. ..... D15/89
7,293,665 B1 * 11/2007 Hardy et al. ..... 211/153
7,472,796 B2 * 1/2009 Dunn ..... 211/153
2005/0173401 A1 * 8/2005 Bakanowski et al. ..... 219/412
2005/0204933 A1 * 9/2005 Freese et al. ..... 99/450
2005/0218097 A1 10/2005 Dunn
2006/0065265 A1 * 3/2006 Erdmann et al. ..... 126/339

* cited by examiner

FULL DEPTH RACK

RELATED APPLICATIONS

This application claims the benefit of U.S. Provisional Application No. 60/731,346, filed on Oct. 28, 2005, the entire disclosure of which is hereby incorporated herein by reference.

FIELD OF THE INVENTION

The present invention relates to racks for appliances, and more particularly, to a full depth rack for an oven.

BACKGROUND OF THE INVENTION

Appliances, such as ovens, often have one or more racks generally within the appliance. For example, the racks can be useful for the placing of cookware, food, and other items, within the oven. The racks can place the cookware generally towards the middle of the oven, and can keep the cookware away from heating elements and the like. In addition, ovens with multiple racks allow for placement of cookware on a variety of levels within the oven, thereby increasing the total volume of available cooking.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Appliance racks, and specifically oven racks, are often of wire form construction. More specifically, an outer wire frame and a support platform, which is constituted by a plurality of fore-to-aft and laterally spaced wires, define a typical oven rack. The wires are substantially evenly spaced across the entire rack for use in supporting food items to be cooked.

Turning initially to FIGS. 1 and 2, a known prior art rack 110 for an appliance, such as an oven, is illustrated. The oven rack 110 is located within an interior oven cavity 100. The oven cavity 100 is defined by a rear wall 102 and opposed side walls 104 (only one shown). The opposed side walls 104 include downward-facing projections 126 formed within corresponding guide rails 125. At least one protrusion, such as a fan assembly 106, light assembly 108 or the like, projects into the oven cavity 100 from the rear wall 102 to limit the space available for the oven rack 110 and items supported thereon.

The known oven rack 110 includes a frame 112 supporting a plurality of bars 114 and an optional cross-member 116. The frame 112 comprises a front edge 118 and an upwardly extending rear edge 120 joined by first and second side edges 122, 124. However, the upwardly extending rear edge 120 acts as a stop for item(s) placed on the oven rack. Further, the protrusions 106, 108 limit the distance that the rear edge 120 can extend into the oven cavity 100. For instance, when cookware, such as a cookie sheet 128, is placed on the rack, the cookie sheet 128 stops when a rear edge of the cookie sheet 128 contacts the upwardly extending rear edge 120 of the oven rack 110, thereby limiting a size of cookie sheet 128 that can be positioned on the rack 110 (i.e., the edge of the cookie sheet 128 extends beyond the front edge 118 of the rack 110). FIG. 2 further illustrates an interference between the conventional oven rack 110 and a cookie sheet 128 that is small enough to fit within the oven cavity but too large to fit on the conventional rack 110. For example, a large amount of wasted oven space is located between the cookie sheet 128 and the rear wall 102, as is shown by distance $D_1$. Accordingly, there is a continuing need for an improved rack.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, a rack for an appliance comprises a support platform including a support frame and a plurality of elongated support wires attached to the support frame to form a support surface extending generally along a plane. At least one leg section is attached to the support platform and extends a distance along a longitudinal axis of the support platform that is less than half of the total length of the support platform. An upwardly projecting portion is adapted to engage structure of an appliance to inhibit the rack from being removed therefrom.

In accordance with another aspect of the present invention, a rack for an appliance comprises a support platform including a support frame having a front member, rear member, and opposed side members, and a plurality of elongated support wires attached to the support frame to form a support surface extending generally along a plane. The rear member of the support frame extends along a substantially full length of the support platform. A portion of the rear member is bent inwardly in a direction towards the front member so as to be spaced a distance from a rear wall of an appliance.

In accordance with another aspect of the present invention, an arrangement for supporting items within an appliance comprises an appliance including an interior cavity having a rear wall and opposed side walls. The rear wall includes at least one projection extending a distance within the interior cavity and the opposed side walls each include a rack guide and a stop portion. The arrangement further includes a support rack including a support frame having a front member, rear member, and opposed side members, a plurality of elongated support wires attached to the support frame to form a support surface extending generally along a plane, and an upwardly projecting portion. The opposed side members are adapted to engage the rack guides to support the support rack within the interior cavity, and a portion of the rear member is bent inwardly in a direction away from the rear wall so as to be spaced a distance from the at least one projection. The upwardly projecting portion is adapted to interfere with the stop portion of an associated rack guide to inhibit the support rack from being removed from the interior cavity.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF AN EXAMPLE EMBODIMENT

Figure 1:
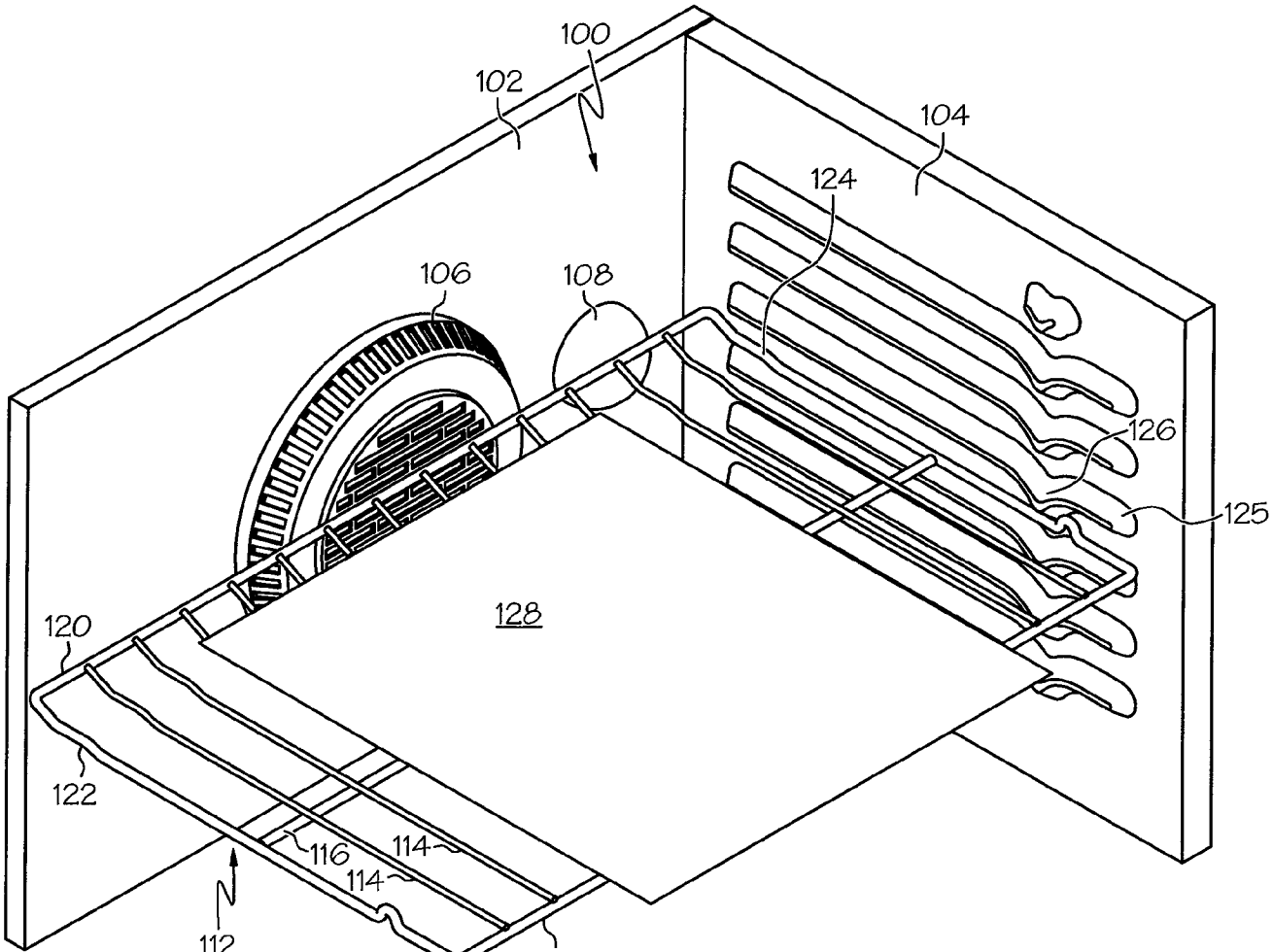
FIG. 1 (PRIOR ART)
FIG. 1 illustrates a perspective view of an example prior art oven rack.

An example embodiment of a rack that incorporates aspects of the present invention is shown in the drawings. It is to be appreciated that the shown example is not intended to be a limitation on the present invention. For example, one or more aspects of the present invention can be utilized in other embodiments and even other types of racks.

Figure 3A:
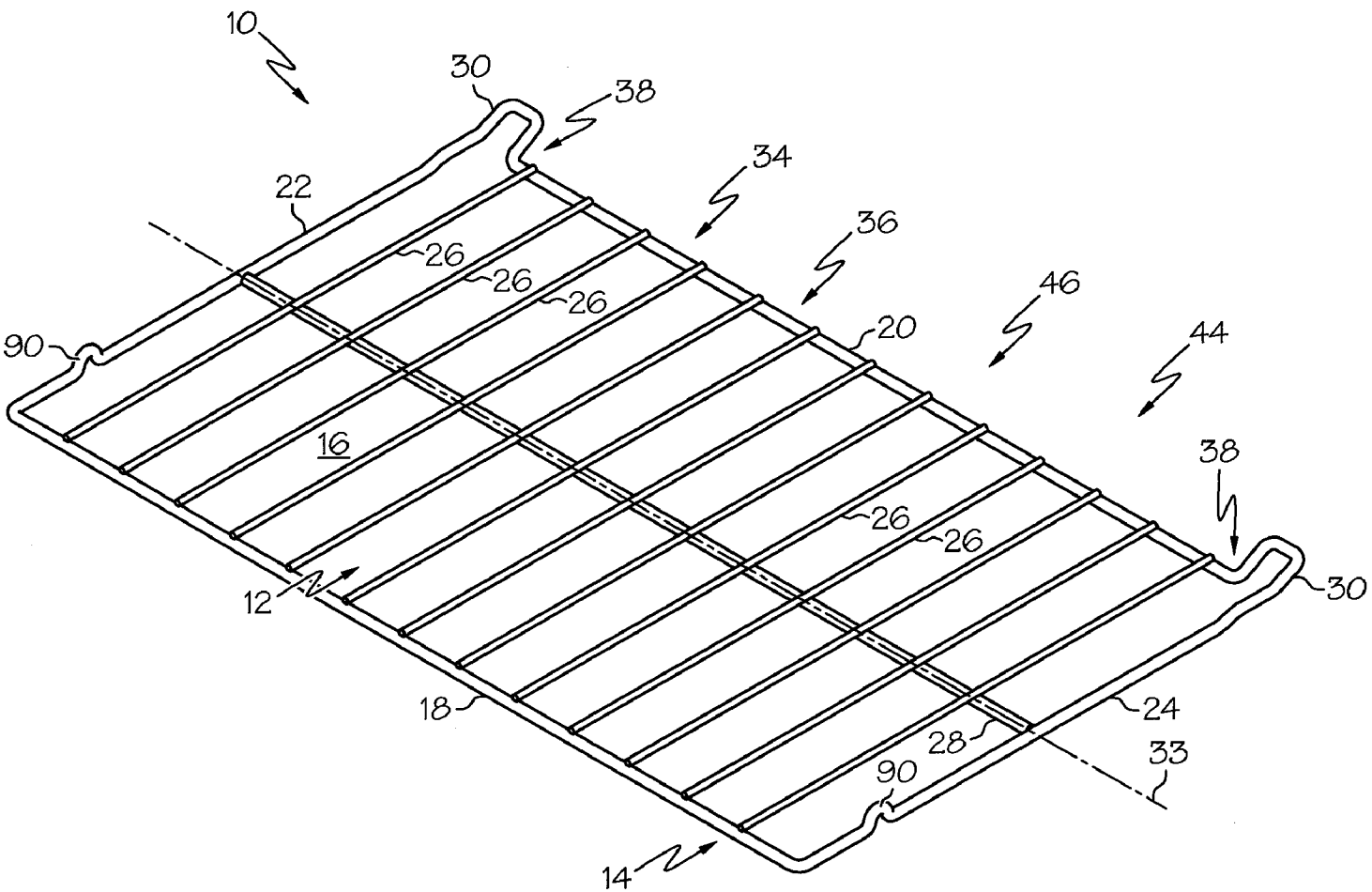
FIG. 3A illustrates a perspective view of an example appliance rack in accordance with an aspect of the present invention.

Turning to the shown example of FIG. 3A, an example of a rack 10 for an appliance, such as an oven, is illustrated in accordance with an aspect of the present invention. It is to be appreciated that the specifics of this example rack 10 can include portions that are identical or similar to that of other example racks also discussed herein. To indicate the identical or similar structure, identical reference numerals, which have the prime or double-prime designation (e.g., "'" or """), are utilized. The various example racks 10, 10', 10" may have identical construction, or they may have certain dissimilar features without deviating from the present invention. As such, details of a first example rack 10 are shown with the understanding that the other example racks 10', 10" may be identical, similar, or even different.

Figure 5:
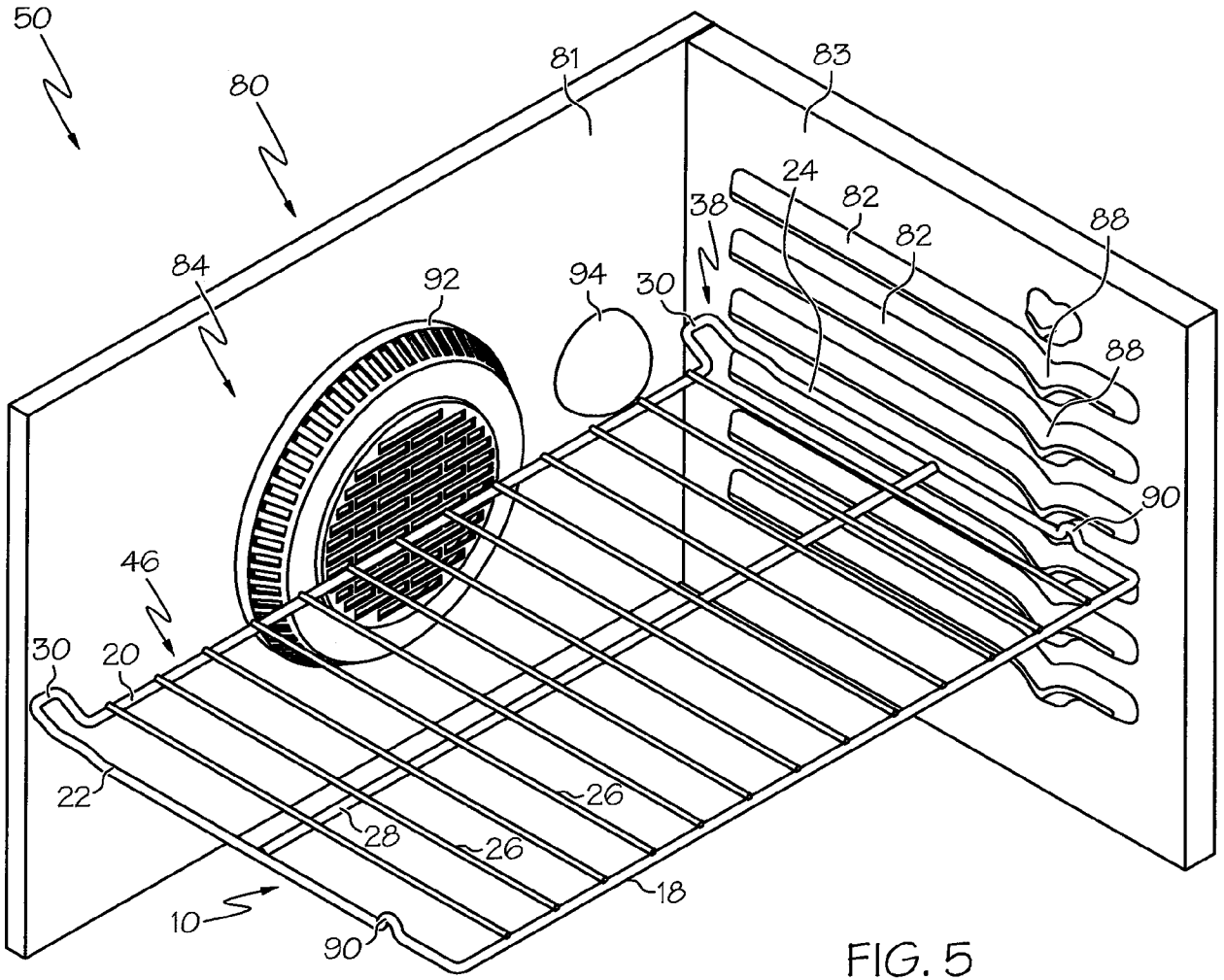
FIG. 5 illustrates a perspective view of the appliance rack in an oven environment in accordance with an aspect of the present invention.

The rack 10 includes a support platform 12 having a support surface 16 adapted to support various items, such as food and/or cookware, within an appliance, such as an oven 80 (see FIG. 5). The rack 10 can be constructed from metal wire, such as iron coated with nickel or steel coated with porcelain, though it can also be constructed from various other suitable materials (e.g., aluminum, sheet metal, or the like).

The support platform 12 can include a support frame 14. For example, the support frame 14 can include a front member 18, a rear member 20, and opposed side members 22, 24. The front member 18, rear member 20, and side members 22, 24 can be attached together to form the support frame 14 in various manners, such as by welding, adhesives, or fasteners, and/or can even be formed from a single piece of member. As shown, the support frame 14 can have a generally rectangular geometry, through it is to be appreciated that the support frame 14 can have various other geometries.

Figure 4:
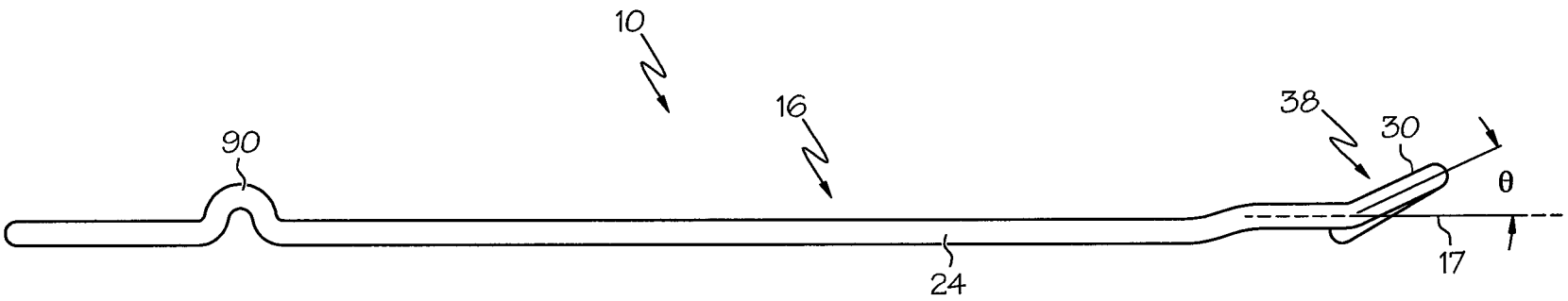
FIG. 4 illustrates a side view of the example rack of FIG. 3A.

A plurality of elongated support wires 26 can be attached to the support frame 14 to form the support surface 16 extending generally along a plane 17 (see FIG. 4). For example, as shown, the front and rear members 18, 20 can be substantially coplanar, and the plurality of elongated support wires 26 can extend therebetween and along a transverse axis of the main section 12. The elongated support wires 26 can be welded, or otherwise secured, to the support frame 14. Further, at least one cross member 28 or strengthening member can be provided across a portion of the elongated support wires 26. For example, the cross member(s) 28 can extend along a longitudinal axis of the support platform 12. In addition or alternatively, the cross member(s) 28 can also be welded or otherwise secured to the side members 22, 24, though they can also be welded or otherwise secured to the elongated support wires 26.

The cross member(s) 28 can operate to mitigate sagging of the support surface 16 with respect to the front member 24 when heavy food, cookware, or the like (not shown) is placed on the primary platform area 16. Sagging of the support surface 16 presents problems with easily sliding the food or cookware from the support surface 16 without interference from the front member 24. Further, the support wires 26, support frame 14, and/or cross member(s) 28 can be manufactured from metal wire or any other suitable material which provides adequate strength to support items such as cake pans, pizza stones and casseroles, or the like, and withstands the heat of an oven. It is to be appreciated that the cross member(s) 28 can be oriented in various other manners, including transverse or angled relative to the elongated support wires 26.

Figure 3B:
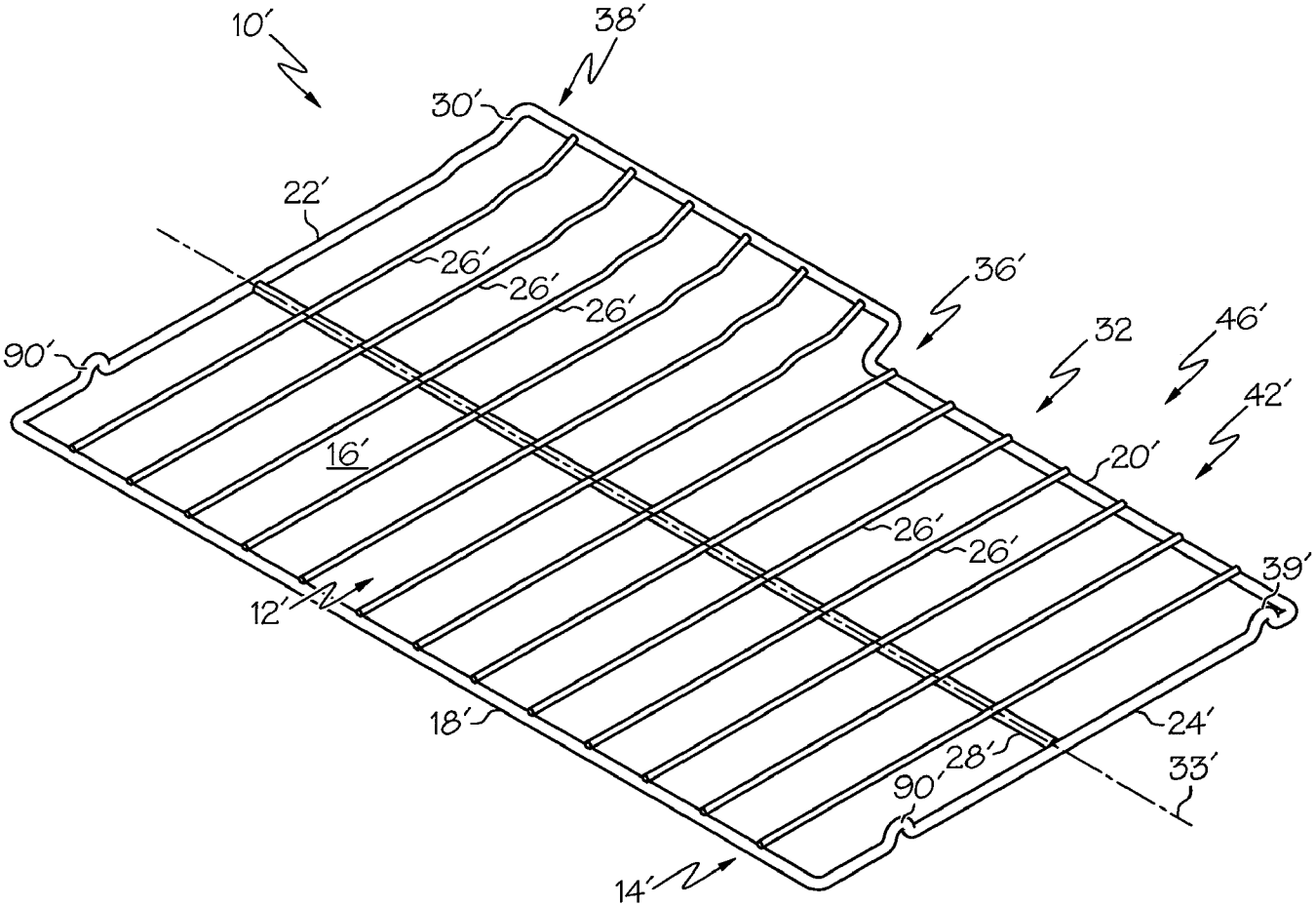
FIG. 3B illustrates an alternative example of the rack of FIG. 3A in accordance with another aspect of the present invention.

The rack 10 can also include at least one leg section 30 attached to the support platform 14. For example, as shown in FIG. 3A, the rack 10 can include a pair of leg sections 30 disposed on opposing sides of the support platform 14. In another example embodiment, as shown in FIG. 3B, the rack 10' can include only a single leg section 30'. In yet another example, not shown, the rack 10 can include three or more leg sections 30 disposed at various locations across the rear member 20, such as located adjacent and/or between various protrusions 92, 94 (see FIGS. 5-6) that can extend into an interior cavity 84 of an appliance 80.

Each of the leg sections 30 can extend a distance along a longitudinal axis 33 of the support platform 14. In one example, the leg section(s) 30 can extend a distance that is equal to or greater than half of the total length of the support platform 14. In another example, the leg section(s) 30 can extend a distance that is less than half of the total length of the support platform 14. Thus, as shown in FIG. 3A, a pair of leg sections 30 can each extend respective distances along the longitudinal axis 33 and can cooperate with the support frame 14 to form a substantially U-shaped rear edge 34. Alternatively, as shown the example embodiment of FIG. 3B, a single leg section 30' can extend a distance along the longitudinal axis 33' and can cooperate with the support frame 14' to form a substantially L-shaped rear edge 32. It is to be appreciated that the rack 10 can include various numbers of leg sections 30 disposed in various locations on the rack 10, and that the leg sections 30 can each extend various distances along the longitudinal axis 33. Thus, the various leg sections 30 can form variously shaped rear edges that provide a clearance area 46 to accommodate a wide variety of protrusions 92, 94 that may extend variously within an interior cavity 84 of an appliance 80 (see FIGS. 5-6).

Figure 3C:
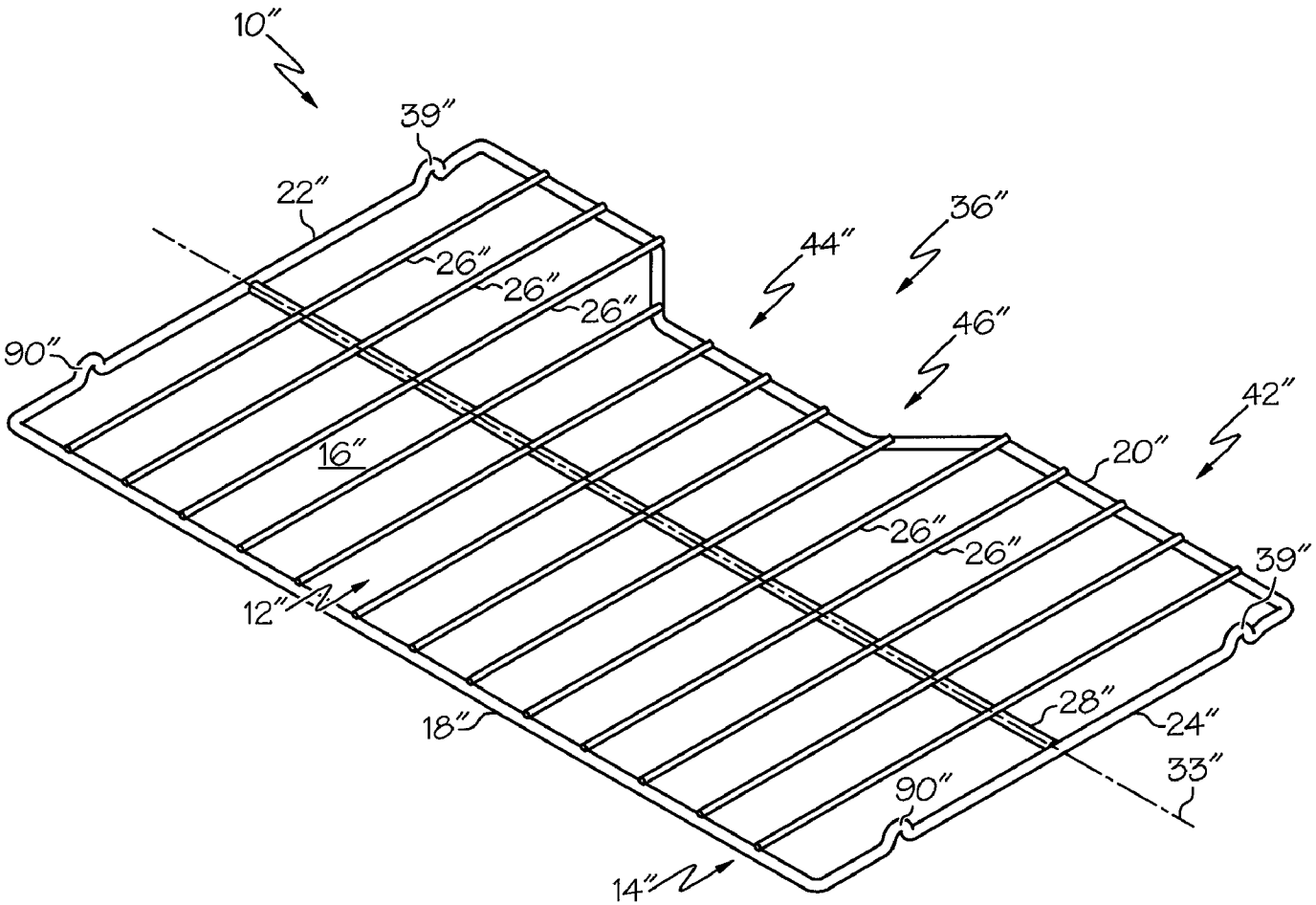
FIG. 3C illustrates another alternative example of the rack of FIG. 3A in accordance with another aspect of the present invention.

In accordance with another aspect of the present invention, as shown in FIG. 3C, the rear member 20" of the support frame 14" can extend along a substantially full length of the support platform 12". In addition, a portion 36" of the rear member 20" can be bent inwardly in a direction towards the front member 18" so as to be spaced a distance from a rear wall 81 of an appliance, such as a oven 80. It is to be appreciated that the inwardly bent rear member 20" can provide the previously discussed clearance area 46".

In addition or alternatively, the inwardly bent rear member 20" can form various other geometries. Thus, as shown in FIG. 3A, the portion 36 of the rear member 20 can be bent inwardly to form a substantially U-shaped geometry 44. Alternatively, as shown in FIG. 3B, the portion 36' of the rear member 20' can be bent inwardly to form a substantially L-shaped geometry 42'. Alternatively, as shown in FIG. 3C, the portion 36" of the rear member 20" can be bent inwardly to form a U-shaped geometry 44" having angled sides. As a result of the inwardly bent geometry, the rear member 20 can incorporate the leg section(s) 30 previously described herein. It is to be appreciated that this aspect of the invention can also include various other features as discussed herein.

Further, in accordance with various aspects of the invention, the rack 10 can also include an upwardly projecting portion 38 that is adapted to engage structure (e.g., a stop portion) of an appliance 80 to inhibit the rack 10 from being removed therefrom. For example, as shown in FIG. 5, the upwardly projecting portion 38 can be adapted to engage a stop portion of the oven 80 that includes downward-facing projection(s) 88 formed with various guide rails 82 in an oven cavity 84. In addition or alternatively, the upwardly projecting portion 38 can be adapted to engage various other corresponding structure(s) disposed within the oven cavity 84 to inhibit the rack 10 from being removed from the oven cavity 84.

The rack 10 can include various numbers of upwardly projecting portion 38 that can comprise various forms. In one example, as shown in FIGS. 3B-3C, the upwardly projecting portion 38' can comprise an inverted "U" shaped element 39' that can be attached to, or formed with, one or both of the side members 22', 24' of the support frame 14'. The element 39' can also include various other geometries or forms that act as a stop, such as a solid element (i.e., a solid sphere, polygon, or the like), a stepped portion, or even a movable portion. As shown in FIG. 3B, the rack 10' can include a single "U" shaped element 39', and can include other structure forming another upwardly projecting portion 38', as will be more fully discussed herein. Alternatively, as shown in FIG. 3C, the rear member 20" can be generally planar along the longitudinal axis 33" and can include a pair of "U" shaped elements 39", each located near a rear corner of the rack 10". In another example, a portion of the rear member 20 can include the upwardly projecting portion 38. Indeed, in any of the aforementioned examples, the leg portion(s) 30 can extend substantially co-planar with the support surface 16.

In yet another example, as shown in FIGS. 3A and 4, a portion of one or more of the leg section(s) 30 can include the upwardly projecting portion 38. For example, as shown, at least one of the leg sections 30 can extend away from the support platform at an upward angle Θ relative to the plane 17 of the support surface 16. In one example, the upward angle Θ can be approximately 30°, though various other angles are also contemplated to be within the scope of the invention. Thus, as shown in FIG. 5, when the rack 10 is pulled from the oven 80, the upwardly angled portion of the leg section(s) 30 can engage the downward-facing projection 88 of the guide rails 82 to thereby inhibit the rack 10 from being removed from the oven cavity 84. As such, the rack 10 itself can be oriented at an angle relative to the oven 80 to permit the leg section(s) 30 to pass by the downward-facing projection(s) 88. It is to be appreciated that various portions of the leg section(s) 30 can include the upwardly projecting portion(s) 38. For example, substantially an entire leg section 30 can be angled upwardly. In another example, only the outward-most portion of the leg section(s) 30 can be angled upwardly, such as by turning up the corners of the rack 10 where the rear member 20 and the side members 22, 24 of the support frame 14 meet. The upwardly projecting portion 38 can extend upwardly along multiple axes and/or angles (e.g., inwardly and/or outwardly), such as with upwardly curved and/or winged sections. It is further to be appreciated that where the leg sections 30 do not include an upwardly projecting portion 38 (e.g., it is attached to or formed with the rear member 20 or the side members 22, 24), the leg sections 30 can have a substantially flat geometry, and can even be co-planar to and/or formed with the support surface 16.

The rack 10 can also include various other features. For example, the rack 10 can include a handle (not shown) to facilitate pulling out and/or removing the rack 10 from an oven 80. A gap (not shown) between the handle and the support frame 14 can be of a size such that a user can comfortably grasp the handle to pull the rack 10 from the oven 80. The handle can extend across an entire length of the rack 10 and can extend forwardly from substantially parallel with the front frame member 18. Accordingly, when the rack is in use, at least a portion of the handle can always be exposed. For example, if a cookie sheet 96 (see FIGS. 5-6) is placed at a center portion of the rack 10 such that the cookie sheet 96 covers a central portion of the rack (i.e., the support surface 16), a user can grab the handle from either or both end portions of the rack 10. In addition or alternatively, the support platform 12 can include one or more upward-facing projection(s) 90 attached to or integrally formed in the wire frame of each of the sides 22, 24 of the support frame 14 to facilitate alignment of the rack 10 within the oven 80. In addition, the upward-facing projections 90 can be configured to interact with corresponding downward-facing projections 88 of the guide rails 82 to restrain insertion of the rack 10 within the interior cavity 84.

Figure 6:
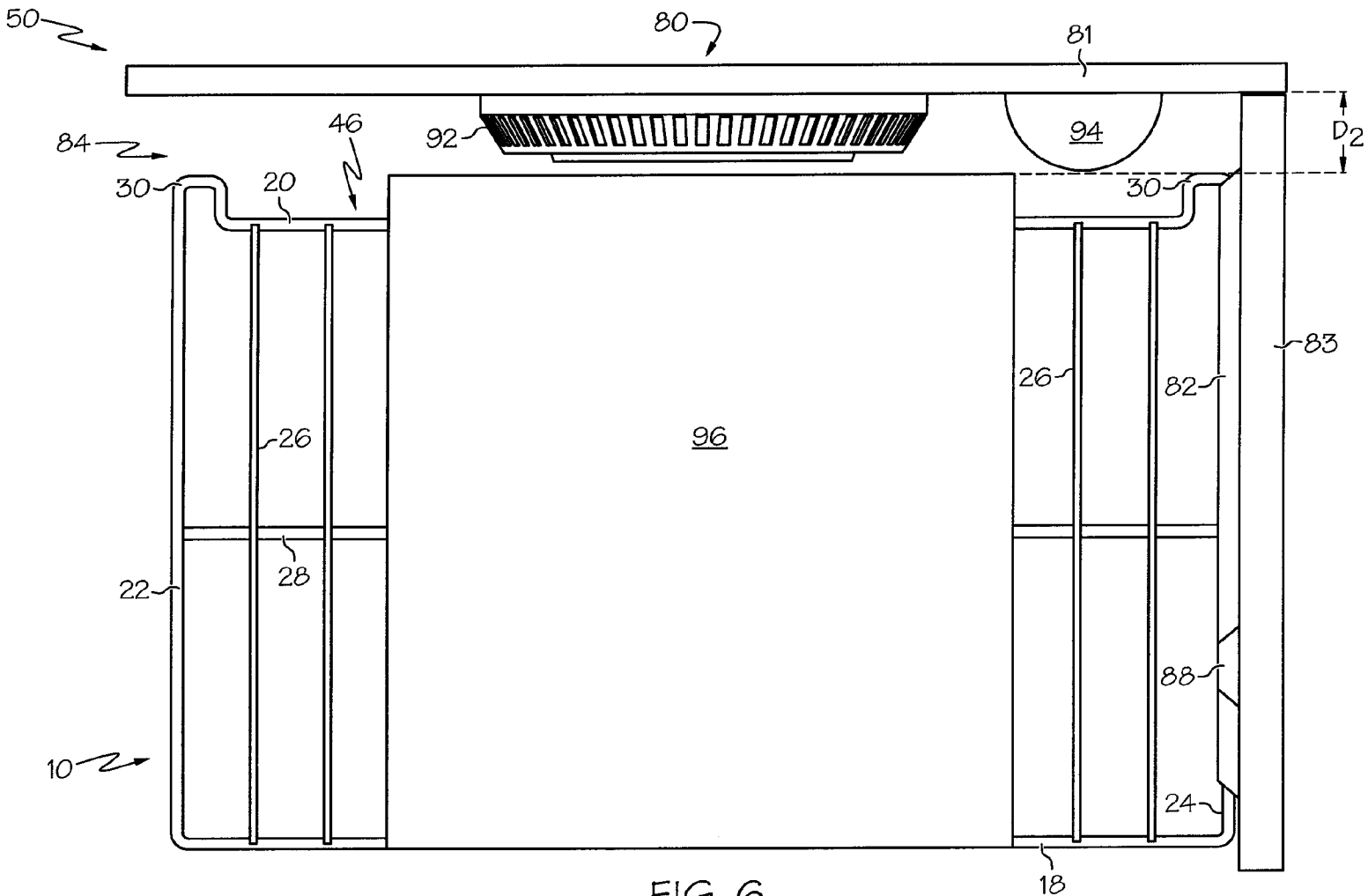
FIG. 6 illustrates a top view of the appliance rack of FIG. 5.

Turning now to the examples shown in FIGS. 5-6, an arrangement 50 for supporting items within an appliance is illustrated. As shown, the rack 10 of the present invention is illustrated employed within an oven environment 80. For example, the oven 80 can include an interior cavity 84 having a rear wall 81 and opposed side walls 83 (only one shown). The rear wall 81 can include at least one projection extending a distance within the interior cavity 84. For example, the projection(s) can include convection fan assembly 92 and/or light assembly 94, though various other projections are also contemplated to be within the scope of the invention. As shown in FIG. 6, the projections 92, 94 can intrude into the oven cavity 94 and can occupy valuable space therein that can otherwise be used for food, cookware, or the like.

Further, the opposed side walls 83 can include rack guide rails 82. Thus, the support frame 14 of the support platform 12 can be supported within an oven cavity 84 by the guide rails 82 (e.g., the side members 22, 24 of the support frame 14 can be supported by the guide rails 82). In addition, the upward-facing projection(s) 90 attached to or integrally formed with the sides 22, 24 of the support frame 14 can engage the corresponding downward-facing projections 88 of the guide rails. Specifically, the upward-facing projections 90 of the support platform 12 can be adapted to contact the downward-facing projections 90 of the top guide rails 82 such that an inward stop is created to properly align the support platform 12 within the standard rack location of the oven 80 (i.e., insertion depth).

Accordingly, with the rack 10 supported within the oven cavity 84, the support surface 16 of the support platform can be utilized to support various items (e.g., food or cookware) for cooking within the oven 80. In addition or alternatively, various items can also be supported on various other oven racks (e.g., supported by other guide rails 84, other racks not shown) simultaneously without the need to add or remove any other racks.

Figure 2:
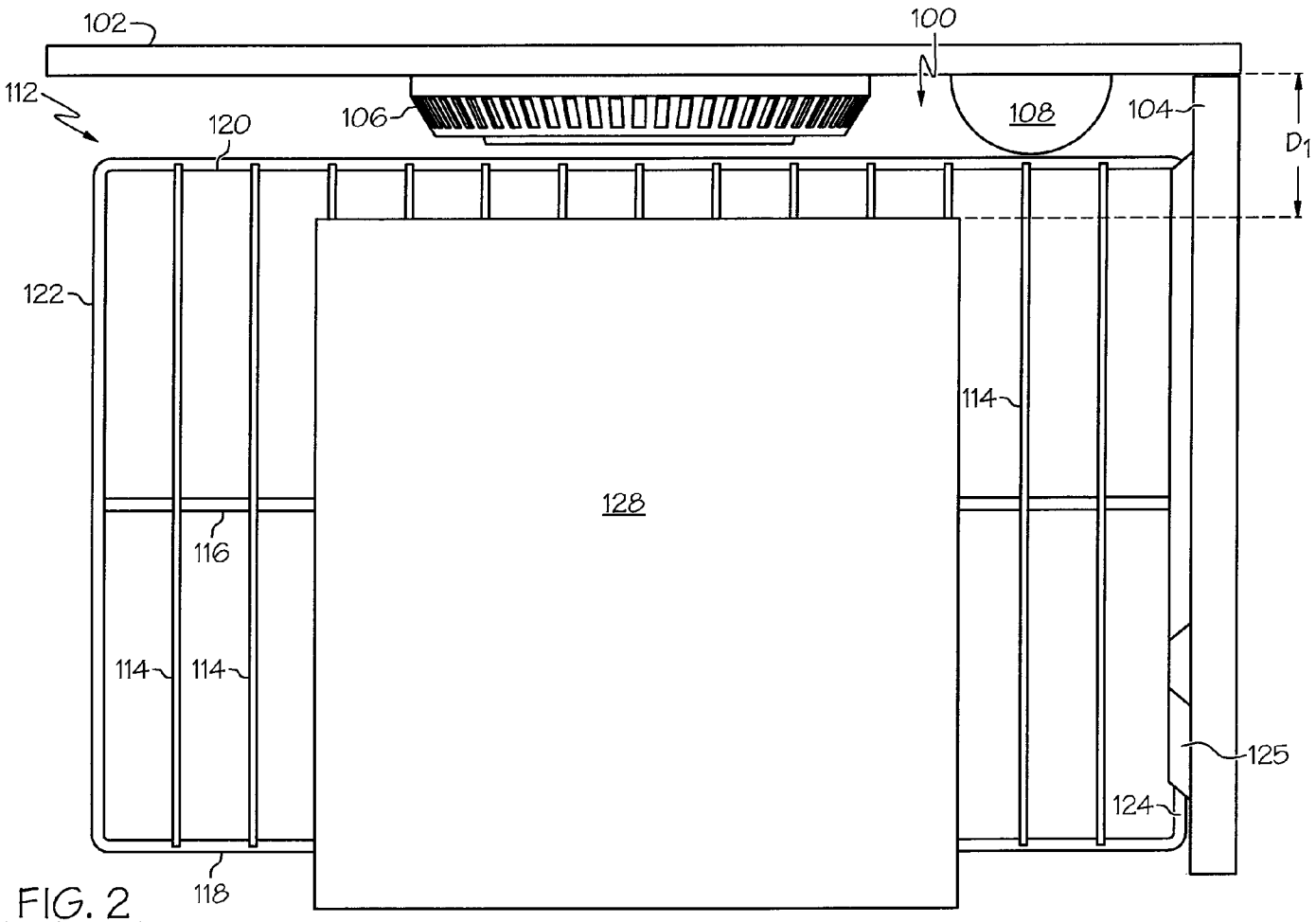
FIG. 2 (PRIOR ART)
FIG. 2 illustrates a top view of the prior art rack of FIG. 1.

Normally, as discussed with reference to the prior art, the protrusions 92, 94 of the rear wall 81 can limit the distance that the rear edge 20 can extend into the oven cavity 84. However, because a rear portion of the rack 10 can include various geometries (e.g., L-shaped or U-shaped geometries)

due to the leg section(s) 30 and/or the inwardly bent rear member 20, cookware, such as a cookie sheet 96, can be inserted relatively further into the interior cavity 84 of the oven 80. Thus, the various geometries (e.g., L-shaped or U-shaped geometries) can provide a clearance area 46 between the support platform 12 and the rear wall 81 for receiving the projections 92, 94. Indeed, as shown in FIG. 6, the cookie sheet 96 (or other cookware) can be inserted into the oven cavity 84 as far as the protrusions 92, 94 will permit (i.e., the edge of the cookie sheet 128 does not extend beyond the front edge 18 of the rack 10). In addition or alternatively, if the oven 80 has no projections 92, 94, the cookie sheet 96 (or other cookware) could be inserted to a full depth of the oven cavity 84 (i.e., all the way up to the rear wall 81). Thus, the cooking capacity of the oven rack 10 is limited only by a depth of the oven cavity 84 instead of a depth of the rack 10, as in conventional oven rack designs. Therefore, the amount of wasted oven space can be minimized between the cookie sheet 96 and the rear wall 81. In one example, the wasted spaced is shown by distance $D_2$ (see FIG. 6), which is relatively less that the comparable wasted space of the prior art as shown by distance $D_1$ (see FIG. 2).

It is to be appreciated that the racks of the subject invention can be used in settings other than in an oven. For example, the racks of the subject invention could be used in a refrigerator and/or freezer unit. Further, it is to be appreciated that the racks can be constructed of any suitable material, such as metal, plastic, and the like. Further still, the frame, the bars, and the cross-member(s) need not be constructed from the same materials.

The size of the frame of the rack of the subject invention also depends upon the intended use of the rack. In the various example embodiments, the rack is sized to slide into or replace a rack of a conventional oven. Likewise, the bars are spaced to accommodate cookware. The frame can be made larger to fit commercial ovens or sized to fit any apparatus in which the racks are to be used. The bars of the rack can be spaced appropriately within the frame to hold any designated item.

The invention has been described with reference to various example embodiments. Obviously, modifications and alterations will occur to others upon a reading and understanding of this specification. It is intended to include all such modifications and alterations insofar as they come within the scope of the appended claims or the equivalents thereof.

The invention claimed is:

1. A rack for an appliance, comprising;

a support platform including a support frame and a plurality of elongated support wires attached to the support frame to form a support surface extending generally along a plane, the support platform including a rear portion;

at least one leg section positioned at the rear portion of the support platform extending a distance along a longitudinal axis of the support platform that is less than half of a total length of the support platform; and an upwardly projecting portion positioned proximate the rear portion of the support platform that is configured to engage a structure of an appliance to inhibit the rack from being removed therefrom, wherein the at least one leg section cooperates with the support frame to form a substantially L-shaped portion at the rear edge, and wherein the substantially L-shaped portion provides a clearance area for a substantial projection extending from a rear wall of an appliance, the clearance area disposed along a direction generally transverse to the longitudinal axis and between the rear edge and the rear wall of an appliance, wherein the substantial projection includes a convection fan assembly and/or a lighting assembly.

2. The rack of claim 1, wherein the at least one leg section comprises two leg sections disposed on opposing sides of the support platform.

3. The rack of claim 2, wherein support frame includes a rear edge, and wherein the two leg sections cooperate with the support frame to form a substantially U-shaped rear edge.

4. The rack of claim 3, wherein the support platform is adapted to be supported within an appliance having an interior cavity bounded by a rear wall, and wherein the substantially U-shaped rear edge is adapted to provide the clearance area between the support platform and the rear wall that is configured to receive the substantial projection extending a distance into the interior cavity from the rear wall.

5. The rack of claim 1, wherein a portion of the at least one leg section includes the upwardly projecting portion.

6. The rack of claim 5, wherein the upwardly projecting portion of the at least one leg extends away from the support platform at an upward angle relative to the plane of the support surface.

7. A rack for an appliance, comprising:

a support platform including a support frame having a front member, rear member, and opposed side members, and a plurality of elongated support wires attached to the support frame to form a support surface extending generally within a plane, and an upwardly projecting portion that is positioned proximate the rear member and is configured to provide a stop for the rack, to inhibit the rack from being removed from an appliance, wherein the rear member of the support frame extends along a substantially full length of the support platform, and wherein a portion of the rear member is bent inwardly in a direction towards the front member so as to be spaced a distance from a rear wall of an appliance to provide a clearance area for a substantial projection extending from a rear wall of an appliance, the clearance area extending generally within the plane and between the rear edge and the rear wall of an appliance, wherein the substantial projection includes a convection fan assembly and/or a lighting assembly.

8. The rack of claim 7, wherein the rear member has a substantially L-shaped geometry.

9. The rack of claim 7, wherein the rear member has a substantially U-shaped geometry.

10. The rack of claim 9, wherein the support platform is adapted to be supported within an appliance having an interior cavity bounded by a rear wall, and wherein the substantially U-shaped rear member is adapted to provide the clearance area between the support platform and the rear wall that is configured to receive the substantial projection extending a distance into the interior cavity from the rear wall.

11. The rack of claim 7, wherein a portion of the rear member includes the upwardly projecting portion.

12. The rack of claim 11, wherein the upwardly projecting portion extends a distance away from the support platform at an upward angle relative to the plane of the support surface and is adapted to engage a downwardly projecting stop portion of a guide rail of an oven cavity to inhibit the rack from being removed from the oven cavity.

13. An arrangement for supporting items in an appliance, comprising:

an appliance including an interior cavity having a rear wall and opposed side walls, wherein the rear wall includes at least one of a convection fan assembly and a lighting assembly extending a distance within the interior cavity and the opposed side walls each include a rack guide and a stop portion; and a support rack including a support frame having a front member, rear member, and opposed side members, a plurality of elongated support wires attached to the support frame to form a support surface extending generally along a plane, and an upwardly projecting portion, wherein the opposed side members are adapted to engage the rack guides to support the support rack within the interior cavity, and wherein a portion of the rear member is bent inwardly in a direction away from the rear wall so as to be spaced a distance from the at least one substantial projection of the appliance to provide a clearance area for the at least one substantial projection, the clearance area extending generally within the plane and between the rear edge and the rear wall of the appliance, and wherein the upwardly projecting portion of the rack is positioned proximate the rear member and is adapted to interfere with the stop portion of an associated rack guide to inhibit the support rack from being removed from the interior cavity.

14. The arrangement of claim 13, wherein the rear member has a substantially L-shaped geometry.

15. The arrangement of claim 13, wherein the rear member has a substantially U-shaped geometry.

16. The arrangement of claim 13, wherein the rear member includes the upwardly projecting portion and extends a distance away from the support platform at an upward angle relative to the plane of the support surface to engage the stop portion of the interior cavity.

17. The arrangement of claim 16, wherein at least one of the rack guides includes the stop portion.

* * * * *